US007044089B2

(12) United States Patent
Yamada

(10) Patent No.: US 7,044,089 B2
(45) Date of Patent: May 16, 2006

(54) CYLINDER HEAD STRUCTURE OF ENGINE

(75) Inventor: Takayuki Yamada, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 11/054,947

(22) Filed: Feb. 11, 2005

(65) Prior Publication Data

US 2005/0205024 A1 Sep. 22, 2005

(30) Foreign Application Priority Data

Mar. 16, 2004 (JP) ..... 2004-075233

(51) Int. Cl.
*F02F 1/36* (2006.01)

(52) U.S. Cl. ..... 123/41.82 R; 123/41.72

(58) Field of Classification Search ..... 123/41.82 R, 123/41.72

See application file for complete search history.

(56) References Cited

U.S. PATENT DOCUMENTS 4,530,323 A 7/1985 Wakasa
4,993,227 A 2/1991 Nagura et al.
6,024,057 A 2/2000 Betchaku
6,363,893 B1 * 4/2002 Xin et al. ..... 123/41.82 R
2002/0026909 A1 3/2002 Akiwa et al.
2002/0170510 A1 * 11/2002 Iizuka et al. ..... 123/41.84

FOREIGN PATENT DOCUMENTS

JP 59-99150 7/1984

* cited by examiner

*Primary Examiner*—Tony M. Argenbright
*Assistant Examiner*—Katrina Harris
(74) *Attorney, Agent, or Firm*—Nixon Peabody LLP; Donald R. Studebaker

(57) ABSTRACT

In a cylinder head structure of a multi-cylinder engine, a head-side water jacket is provided in the cylinder head, a lateral rib extending in the engine width direction is provided at an upper face of the portion located between cylinders of bottom deck, the lateral rib bifurcates, getting around intake-side and exhaust-side connecting holes connecting the head-side water jacket with a water jacket in cylinder block, its both ends are connected with intake-port and exhaust-port walls, and its top portion is configured so as to become taller gradually from its central portion toward its outside portions.

Accordingly, rigidity of the portion located between cylinders of the cylinder head can be increased in the cylinder-line direction as well as in the vertical direction, which can improve the sealing between the cylinder block and the cylinder head.

5 Claims, 3 Drawing Sheets

FIG. 4
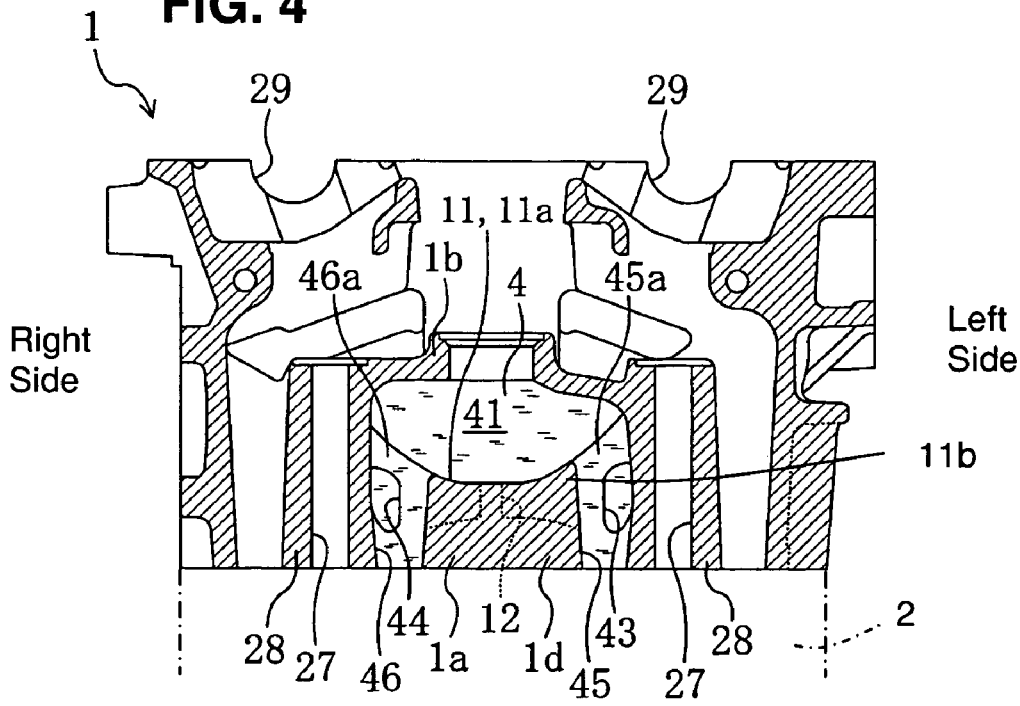
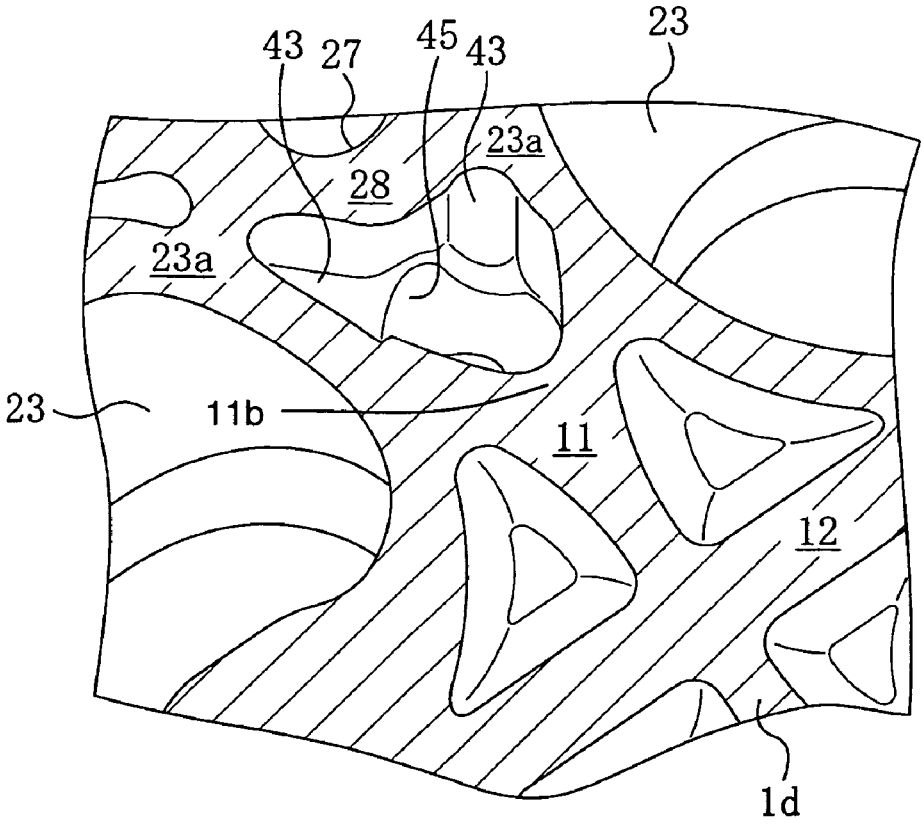
FIG. 5

CYLINDER HEAD STRUCTURE OF ENGINE

BACKGROUND OF THE INVENTION

The present invention relates to a cylinder head structure of an engine, and specifically a technical field of a cylinder head structure in which a water jacket circulating an engine cooling water therein is provided in a cylinder head.

Normally, an engine body comprises a cylinder block and a cylinder head which is attached on the cylinder block. In a multi-cylinder engine, there are generally provided bolt holes at four side corners and both sides of the cylinder head. The cylinder head is fastened to the cylinder block via head bolts being inserted into these bolt holes. The bolt holes at the both sides of the cylinder head are located between adjacent cylinders. In this structure, in order to prevent a so-called gas leakage between the adjacent cylinders and improve the sealing, a sealing means such as a gasket is provided between the upper face of the cylinder block and the lower face of the cylinder head.

However, a portion located between adjacent cylinders of the cylinder head is fastened to a portion of the cylinder block which corresponds to the portion located between cylinders of the cylinder head via the above-described blots located at the both sides. Accordingly, a central portion of the above-described portion located between cylinders of the cylinder head is apt to be raised upward slightly due to the thermal expansion of the cylinder caused by heating. As a result, the face pressure at the portion against the upper face of the cylinder block may decrease, thereby deteriorating the sealing between them. Particularly, this deterioration of sealing may be critical to a compact engine with a small distance between adjacent cylinders.

Japanese Utility Model Laid-Open Publication No. 59-99150 discloses a cylinder head structure equipped with a reinforcing rib which is provided at the portion located between cylinders, as a countermeasure for the above-described problem. Herein, this reinforcing rib is provided so as to connect the central portion of the portion located between cylinders with boss portions of bolt holes which are formed at both sides of this portion. Namely, the rigidity of the portion located between cylinders may be increased by the reinforcing rib connecting the central portion of the portion with the boss portions of the bolt holes, and any improper deformation due to the thermal expansion may be restrained thereby.

Meanwhile, the water jacket for cooling the engine body including the cylinder head is generally provided in the cylinder head. Herein, it is required for a connecting hole provided for interconnecting the water jacket formed in the cylinder block and the water jacket formed in the cylinder head to be disposed in a so limited space in the cylinder head.

It is considered, for example, that such connecting holes are located at the above-described portion located between cylinders and at its outer side in the engine width direction respectively. In this case, however, it may not be easy to connect the central portion of the portion located between cylinders and the boss portions at both sides by the reinforcing ribs like the structure disclosed in the above-described patent document.

Also, it may be necessary to further increase the rigidity of the cylinder head in the cylinder-line direction as well as in the vertical direction, in order to properly prevent the gas leakage between adjacent cylinders of the cylinder head which includes many holes such as the water jackets.

SUMMARY OF THE INVENTION

The present invention has been devised in view of the above-described problem, and an object of the present invention is to provide a cylinder head structure which can increase the rigidity of the portion located between cylinders of the cylinder head in the cylinder-line direction as well as in the vertical direction, thereby improving the sealing between the cylinder block and the cylinder head.

According to the present invention, there is provided a cylinder head structure of an engine, in which there are provided two intake ports and two exhaust ports for each cylinder of a multi-cylinder engine and an engine cooling water is circulated in a cylinder head.

And, this cylinder head structure comprises a main water jacket to form part of a head-side water jacket provided in the cylinder head, the main water jacket being separated by an upper face of a bottom deck of the cylinder head forming a combustion chamber of the cylinder and extending from an engine front end portion to an engine rear end, an intake-side connecting hole and exhaust-side connecting hole to form part of the head-side water jacket, the intake-side and exhaust-side connecting holes being provided at a portion located between cylinders of the bottom deck of the cylinder head and at outer both sides in an engine width direction respectively so as to interconnect the main water jacket and a water jacket formed in a cylinder block, and a lateral rib provided at an upper face of the portion located between cylinders of bottom deck of the cylinder head so as to extend in the engine width direction.

Also, the above-described lateral rib bifurcates at both ends thereof so as to get around the above-described intake-side and exhaust-side connecting holes respectively, both ends of bifurcated portions of the lateral rib are respectively connected integrally with intake-port walls and exhaust-port walls of adjacent cylinders which respectively forms the intake ports and exhaust ports, and a top portion of the lateral rib is configured so as to become taller gradually from a central portion thereof toward outside portions thereof in the engine width direction.

Accordingly, since the head-side water jacket including the main water jacket is provided in the cylinder head and the cooling water is circulated in the main water jacket, the upper portion above the combustion chamber and its peripheral portion are cooled. And, since the head-side water jacket is connected with the block-side water jacket via the intake-side and exhaust-side connecting holes, the cooling water is circulated between the head-side and block-side water jackets.

And, there is provided the lateral rib provided at the upper face of the portion located between cylinders of bottom deck of the cylinder head, which corresponds to the portion located between adjacent cylinders of the cylinder block, so as to extend in the engine width direction. This portion located between cylinders is so formed in narrow and thin shape as to have a relatively low rigidity. Accordingly, the vertical-direction rigidity of this portion can be increased by the lateral rib.

Also, the lateral rib bifurcates at its intake-side end so as to get around the intake-side connecting hole, and both ends of this bifurcated portion are connected integrally with the intake-port walls of adjacent cylinders respectively. Meanwhile, the lateral rib bifurcates at its exhaust-side end so as to get around the exhaust-side connecting hole, and both ends of this bifurcated portion are connected integrally with the exhaust-port walls of adjacent cylinders respectively. Generally, the intake-port walls or the exhaust-port walls have relatively higher rigidity than the above-described portion located between cylinders with the narrow and thin shape. Accordingly, the rigidity of this portion located between cylinders can be increased properly by the lateral rib getting around the intake-side and exhaust-side connecting holes.

Further, since the both ends of the bifurcated portion are connected integrally with the port walls of adjacent cylinders respectively, the rigidity of the above-described portion located between cylinder can be increased in the cylinder-line direction as well as in the engine vertical direction.

Also, since the top portion of the lateral rib is configured so as to become taller gradually from its central portion toward its outside portions in the engine width direction, the relatively large passage area can be provided at the central portion of the main water jacket and the sufficient flowing of the cooling water toward the engine rear can be ensured. As a result, the combustion chamber can be cooled effectively. Also, the vertical-direction rigidity of the outside portion of the cylinder head can be increased and the connecting portion of the intake-port and exhaust-port walls can be strengthened, thereby further increasing the rigidity.

Namely, according to the present invention, even if the intake-side and exhaust-side connecting portions are provided at the portion located between cylinders of the bottom deck, the rigidity of this portion located between cylinders can be properly increased by the lateral rib, which bifurcates at the both ends so as to get around the intake-side and exhaust-side connecting holes respectively and whose both bifurcated end portions are connected integrally with the intake-port walls and exhaust-port walls of adjacent cylinders respectively. As a result, the vertical-direction thermal deformation of the portion located between cylinders can be restrained regardless of the temperature increasing of the bottom deck, so that the sealing of cylinders between the cylinder head and the cylinder block can be stabilized and improved. Also, the lateral rib with its top portion configured so as to become taller gradually from its central portion toward its outside portions can provide a high cooling efficiency at the central portion of engine and increase further the rigidity of the portion located between cylinders. Further, the lateral rib bifurcating and connected integrally with intake-port and exhaust-port walls of adjacent cylinders can provide an additional connection in the cylinder-line direction at the cylinder head, thereby increasing the cylinder-line-direction rigidity as well.

According to a preferred embodiment of the present invention, the cylinder head structure further comprises an exhaust-side water jacket to form part of the head-side water jacket, and the exhaust-side water jacket is provided between the exhaust-port wall and the bottom deck of the cylinder head.

And, this exhaust-side water jacket connects with the exhaust-side connecting holes below an opening end of the exhaust-side connecting hole which opens at the main water jacket.

Accordingly, the exhaust port is cooled from below by the exhaust-side water jacket.

Also, since the exhaust-side water jacket connects with the exhaust-side connecting holes below the opening end of the exhaust-side connecting hole which opens at the main water jacket, part of the cooling water, which has been circulated from the block-side water jacket to the head-side water jacket, necessarily flows into the exhaust-side water jacket when flowing into the main water jacket via the exhaust-side connecting hole.

Herein, if the exhaust-side water jacket connects with the exhaust-side connecting holes above the opening end of the exhaust-side connecting hole which opens at the main water jacket, the cooling water, which has flowed into the head-side water jacket from the block-side water jacket, would flow into the main water jacket and the exhaust-side water jacket from the head-side opening end of the exhaust-side connecting hole. In this case, since this cooling water is apt to flow into the main water jacket due to its lower flow resistance, the amount of the cooling water flowing would become small, and the exhaust port may not be cooled effectively.

Then, the structure in which the exhaust-side water jacket connects with the exhaust-side connecting holes below the opening end of the exhaust-side connecting hole can circulate the sufficient amount of cooling water in the exhaust-side water jacket.

Namely, according to the above-described embodiment, by disposing the exhaust-side water jacket below the exhaust port and by circulating the cooling water in the exhaust-side water jacket effectively, the cooling of the exhaust port can be improved.

According to another preferred embodiment of the present invention, below the intake port is provided a nozzle hole for a fuel injector which is provided so as to face the combustion chamber, and there is further provided an intake-side water jacket to form part of the head-side water jacket between a nozzle-hole wall forming the nozzle hole and the intake-port wall.

And, the above-described intake-side water jacket connects with the intake-side connecting holes below an opening end of the intake-side connecting hole which opens at the main water jacket.

Accordingly, the nozzle hole for the fuel injector is provided below the intake port, and the intake-side water jacket is provided between the nozzle-hole wall and the intake-port wall. Then, the fuel injector is cooled by this intake-side water jacket.

Also, since the intake-side water jacket connects with the intake-side connecting holes below the head-side opening end of the intake-side connecting hole like the exhaust-side water jacket, the cooling water can be circulated effectively in the intake-side water jacket.

Namely, according to the above-described embodiment, by providing the nozzle hole for the fuel injector below the intake port and by providing the intake-side water jacket between the nozzle-hole wall and the intake-port wall, the cooling of the fuel injector can be improved.

According to further another preferred embodiment of the present invention, there is further provided a longitudinal rib at a central portion of the upper face of the bottom deck, and this longitudinal rib extends in the cylinder-line direction so as to be connected with the above-described lateral rib, crossing each other.

Accordingly, at the upper face of the bottom deck which corresponds to the combustion chamber and at the central portion in the engine width direction is provided the longitudinal rib extending in the cylinder-line direction, and this longitudinal rib and the lateral rib are connected with each other. Namely, according to the above-described embodiment, the vertical-direction rigidity of the bottom deck can be increased further.

Other features, aspects, and advantages of the present invention will become apparent from the following description which refers to the accompanying drawings.

BRIEF DESCRIPTION OF THE DRAWINGS

FIG. 4 is a sectional view taken along line C—C of FIG. 1.

FIG. 5 is a perspective view illustrating an enlarged section of a portion located between cylinders.

DETAILED DESCRIPTION OF THE INVENTION

Figure 1:
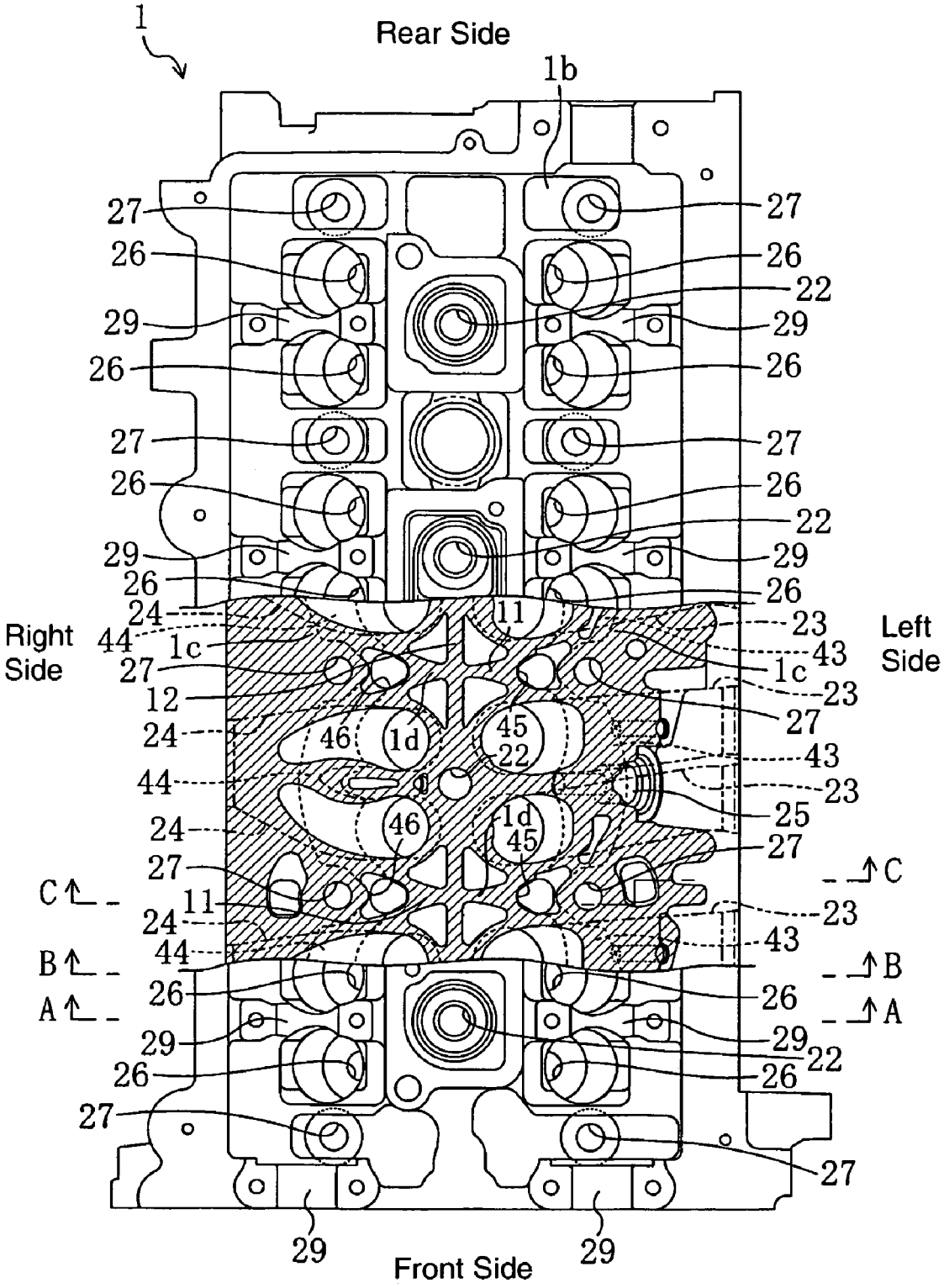
FIG. 1 is a plan view of a partially-cut-off cylinder head according to an embodiment of the present invention.

Hereinafter, a preferred embodiment of the present invention will be described with reference to the accompanying drawings. FIGS. 1 through 5 illustrate a cylinder head according to the preferred embodiment. Reference numeral 1 denotes a cylinder head of a 4-cylinder inline engine, which is attached on a cylinder block 2 (illustrated by a dash-dotted line) via a gasket (not illustrated).

Hereinafter, a longitudinal direction of the cylinder head 1, i.e., a cylinder-line direction thereof, will be referred to as an engine longitudinal direction, and an engine side at which an output end of a crankshaft is located (the upper side in FIG. 1) will be referred to as an engine rear side, while the opposite side thereof (the lower side in FIG. 1) will be referred to as an engine front side. Also, the right side of the engine, when viewed from the rear, will be referred to as an engine right side, while the opposite side thereof will be referred to as an engine left side, as apparent from FIG. 1.

Figure 2:
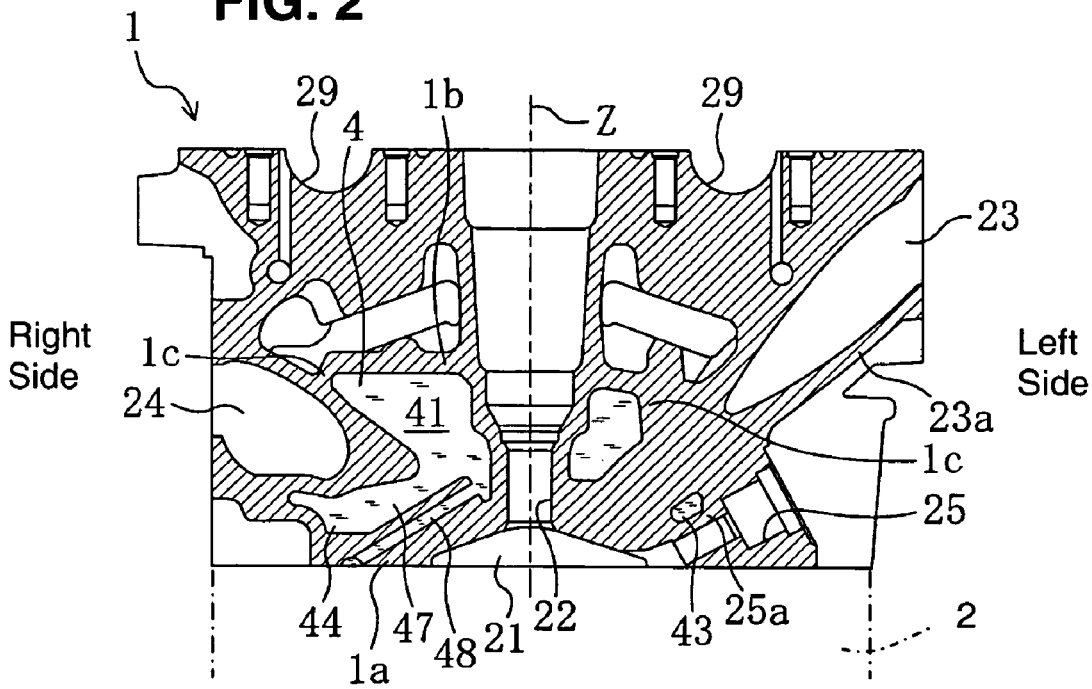
FIG. 2 is a sectional view taken along line A—A of FIG. 1.
Figure 3:
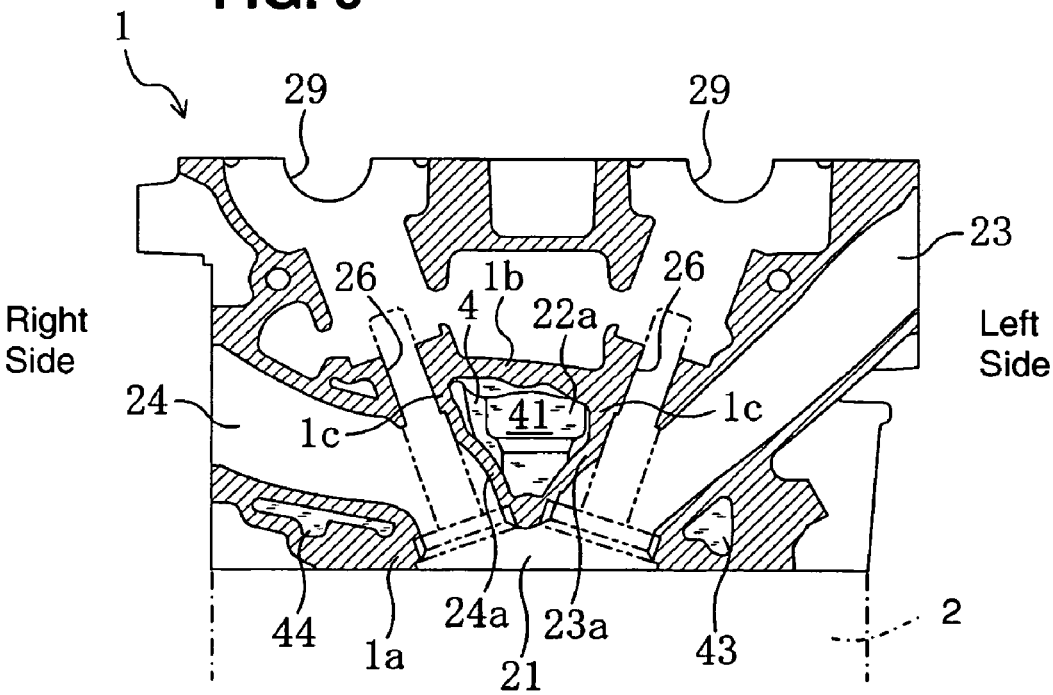
FIG. 3 is a sectional view taken along line B—B of FIG. 1.

At a bottom deck 1*a* constituting a bottom face of the cylinder head 1 are provided ceiling portions 21 . . . 21 of combustion chambers so as to close cylinders formed at the cylinder block 2 from above, as illustrated in FIGS. 2 and 3.

Each combustion-chamber ceiling portion 21 is formed in a so-called pent roof shape as illustrated in FIGS. 2 and 3, which has a plug hole 22 formed at its center. Then, an ignition plug (not illustrated) is inserted into this plug hole 22 from the above of the cylinder head 1 along a cylinder axis z so as to be disposed in the hole vertically. Further, as illustrated in FIG. 1, intake ports 23, 23 and exhaust ports 24, 24 open respectively at the engine left side (the right side in FIG. 1) and the engine right side (the left side in FIG. 1) of slant faces of the combustion-chamber ceiling portion 21, enclosing the ignition plug. Two intake valves and two exhaust valves (not illustrated) are provided at respective opening ends of respective ports.

The intake ports 23, 23, as illustrated in FIG. 3, extend from the respective combustion chambers upward obliquely and substantially straightly, and open independently at the engine right side (see FIG. 1). Meanwhile, the exhaust ports 24, 24 are merged into a single passage and then it extends substantially horizontally and finally opens at the engine right side of the cylinder head 1 (see FIG. 1).

Also, as illustrated in FIGS. 1 and 2, there is provided a nozzle hole 25 to dispose a fuel injector (not illustrated) therein between and below these two intake ports 23, 23. This nozzle hole 25 opens at the combustion chamber at one end and at one side face of the cylinder head at the other end so as to directly inject the fuel into the combustion chamber.

Further, the respective cylinders are disposed closely to each other, and therefore a portion 1*d* of the bottom deck 1*a* which is located between the adjacent cylinders is formed in a thin shape as illustrated in FIG. 1.

Also, as illustrated in FIGS. 1, 2 and 3, there is provided a middle deck 1*b* at a substantially middle level portion of the cylinder head 1. Above the middle deck 1*b* are provided intake and exhaust camshafts (not illustrated) and the like, while below the middle deck 1*b* is provided a head-side water jacket 4 which is enclosed by the bottom deck 1*a*, middle deck 1*b* and jacket side walls 1*c*, 1*c*.

Further, at the middle deck 1*b* are provided disposition holes 26 . . . 26 to dispose the intake and exhaust vales respectively at the intake side and the exhaust side so as to put the plug hole 21 therebetween. Also, there are provided head-bolt through holes 27 . . . 27 and bolt bosses 28 . . . 28 for head bolts (not illustrated) to fasten the cylinder head 1 to the cylinder block 2 so as to enclose the cylinders.

Above the middle deck 1*b* are provided the intake camshaft and the exhaust camshaft to respectively open and close the intake valves and the exhaust valves, which are not illustrated, so as to correspond the above-described disposition holes 26 . . . 26 above these holes. These camshafts are disposed in parallel to each other, extending in the engine longitudinal direction. There are also provided bearing portions 29, 29 for each cylinder at both sides of the plug hole 22 of the cylinder head 1. These intake-side and exhaust-side bearing portions 29 . . . 29 support the intake and exhaust camshafts, respectively.

The above-described head-side water jacket 4 is, as illustrated in FIGS. 2, 3 and 4, located at a central portion in the engine width direction above the bottom deck 1*a* and the intake and exhaust ports 23, 24 . . . . This head-side water jacket 4 comprises a main water jacket 41 extending in the cylinder-line direction from the first combustion-chamber ceiling portion 21 at the foremost portion to the forth combustion-chamber ceiling portion 21 at the rearmost portion, an intake-side water jacket 43 disposed between the intake port 23 and the bottom deck 1*a*, and an exhaust-side water jacket 44 disposed between the exhaust port 24 and the bottom deck 1*a*.

An upper portion of the main water jacket 41 is separated by the middle deck 1*b* and a lower portion thereof is separated by the bottom deck 1*a*. Its both side portions are separated by intake-port walls 23*a* forming the intake ports 23, exhaust-port walls 24*a* forming the exhaust ports 24, the bolt bosses 28, and the jacket side walls 1*c*. Further, at the center of the main water jacket 41 are vertically provided plug-hole walls 22*a* forming the plug holes 22. Thus, the cooling water circulates in the cylinder-line direction along these intake-port walls 23*a*, exhaust-port walls 24*a*, and plug-hole walls 22*a*.

There are respectively provided an intake-side connecting hole 45 and an exhaust-side connecting hole 46, which respectively connect with a block-side water jacket (not illustrated) formed in the cylinder block 2 and extend vertically. These connecting holes 45 and 46 are located in the main water jacket 41 at the intake side and the exhaust side from the center of the portion 1*d* and inside the bold bosses 28, 28, respectively. Namely, at the portion 1*d* located between cylinders are located the head-bolt through holes 27, 27 and the intake-side and exhaust-side connecting holes 45 and 46. Herein, the through holes 27, 27 are located outside and the connecting holes 45 and 46 are located inside, thus these holes 27, 27, 45 and 46 are located in a row.

As illustrated in FIGS. 1, 4 and 5, a lateral rib 11 which extends in the engine width direction is formed at the above-described portion 1*d* located between cylinders at the bottom deck 1*a*. A top portion 11*a* of this lateral rib 11 is configured so as to become taller gradually from its central portion toward its outside portions in the engine width direction. Its both ends have bifurcated portions 11*b* which bifurcate respectively so as to get around the above-described intake-side and exhaust-side connecting holes 45 and 46. And, both ends of these bifurcated portions 11*b* are connected integrally with the intake-port walls 23*a*, 23*a* and the exhaust-port walls 24*a*, 24*a* of the adjacent cylinders, respectively.

Meanwhile, a longitudinal rib 12 extending in the cylinder-line direction is formed at a portion corresponding to the central portion of the combustion-chamber ceiling portion 21 at the bottom deck 1*a*, as illustrated in FIGS. 1, 4 and 5. This longitudinal rib 12 is connected with the lateral rib 11 so as to cross each other.

The above-described intake-side water jacket 43, as illustrated in FIGS. 2 and 3, is formed between the intake-port walls 23*a*, 23*a* and the nozzle-hole wall 25*a* which separate the nozzle hole 25, and extends in the cylinder-line direction to connect with the intake-side connecting holes 45, 45 (see FIG. 4). Thus, the intake-side water jacket 43 connects with the respective intake-side connecting holes 45 at a portion which is located below a head-side opening end 45*a* of the intake-side connecting hole 45 which opens at the main water jacket 41. This is because the above-described bifurcated portion 11*b* of the lateral rib 11, which extends upward, enclosing the intake-side connecting hole 45, is located between the intake-side connecting hole 45 and the main water jacket 41.

The above-described exhaust-side water jacket 44, as illustrated in FIG. 3, is formed between the exhaust-port walls 24*a*, 24*a* and the bottom deck 1*a*, and extends in the cylinder-line direction to connect with the exhaust-side connecting holes 46, 46 (see FIG. 4). Thus, the exhaust-side water jacket 44 connects with the respective exhaust-side connecting holes 46 at a portion which is located below a head-side opening end 46*a* of the exhaust-side connecting hole 46 which opens at the main water jacket 41. This is because the above-described bifurcated portion 11*b* of the lateral rib 11, which extends upward, enclosing the exhaust-side connecting hole 46, is located between the exhaust-side connecting hole 46 and the main water jacket 41. Also, there is provided a connecting portion 47 which interconnects the exhaust-side water jacket 44 and the main water jacket 41 between the respective exhaust ports 24, 24 as illustrated in FIG. 2. Further, a connecting hole 48 which interconnects the block-side water jacket and the head-side water jacket 44 is formed at the connecting portion 47. Each exhaust port 24, which is a passage for exhausting the burned gas with a high temperature, needs to be cooled down actively. Then, the cooling water is actively supplied between the respective exhaust ports 24, 24 from the cylinder-block side via the above-described connecting hole 48.

In the above-described structure, the vertical-direction rigidity of the portion 1*b* located between cylinders at the bottom deck 1*a* is increased by the lateral rib 11. Also, since the both ends of the bifurcated lateral rib 11 are connected integrally with the intake-port walls 23*a*, 23*a* and the exhaust-port walls 24*a*, 24*a* respectively, the rigidity of the portion 1*b* is further improved. Further, since the top portion 11*a* of the lateral rib 11 is configured so as to become taller gradually from its central portion toward its outside portions in the engine width direction, the relatively large passage area is provided at the central portion of the main water jacket 41. Accordingly, the sufficient flowing of the cooling water toward the engine rear can be ensured, thereby cooling the combustion chamber effectively. Also, the vertical-direction rigidity of the cylinder head can be increased, and the connecting portion of the intake-port walls 23*a*, 23*a* and the exhaust-port walls 24*a*, 24*a* can be strengthened. As a result, the rigidity can be further increased. Also, the lateral rib 11 having the bifurcated portion 11*b* can increase the rigidity in the cylinder-line direction as well as in the engine width direction.

Meanwhile, the above-described longitudinal rib 12 can increase the vertical-direction rigidity of the portion corresponding to the combustion-chamber ceiling portion 21.

Next, the circulation of the engine cooing water will be described. The cooling water taken into the cylinder block 2 from the front side flows toward the engine rear in the cylinder block 2 and then flows into the head-side water jacket 4 via the intake-side and exhaust-side connecting holes 45 . . . 46 . . . , the connecting holes 48 . . . and so on. Then, the cooling water also flows toward the engine rear in the head-side water jacket 4, and drains via a cooling-water outlet (not illustrated) which is provided at the rear side of the cylinder head 1.

Herein, since the intake-side and exhaust-side water jackets 43, 44 connect below the head-side opening ends 45*a*, 46*a* of the intake-side and exhaust-side connecting holes 45 and 46 at the bifurcated portion 11*b* of the lateral rib 11, part of the cooling water which will flow into the main water jacket 41 via the connecting holes 45 and 46, necessarily flows into the intake-side and exhaust-side water jacket 43 and 44.

Namely, the engine cooling water cools down the combustion-chamber ceiling portions 21 . . . 21, the intake ports 23 . . . 23, and the exhaust ports 24 . . . 24, while flowing in the main water jacket 41. And, it also cools down the fuel injector, flowing in the intake-side water jacket 43, and cools the exhaust ports 24 . . . 24 from below, while flowing in the exhaust-side water jacket 44.

Accordingly, even in the structure where the intake-side and exhaust-side connecting holes 45 and 46 are provided at the inner side of the engine from the bolt bosses 28, 28 of the portion 1*d* located between cylinders of the bottom deck 1*a*, the rigidity can be increased by the lateral rib 11 provided at the portion 1*d* located between cylinders. As a result, even if the temperature of the bottom deck 1*a* rises, an upward heat deformation of the portion 1*d* located between cylinders can be restrained and the sealing of cylinders between the cylinder head and the cylinder block can be stabilized and improved.

Also, the lateral rib 11 bifurcates at both ends respectively, and the both ends of the bifurcated portions 11*b* are connected integrally with the intake-port walls 23*a*, 23*a* and the exhaust-port walls 24*a*, 24*a* of the adjacent cylinders, respectively. As a result, the rigidity can also be increased in the cylinder line direction.

Further, the vertical-direction rigidity of the portion corresponding to the combustion-chamber ceiling portion 21 of the bottom deck 1*a* can be increased by the longitudinal rib 12.

The fuel injectors can also be cooled effectively by the intake-side water jacket 43 connecting with the intake-side connecting hole 45 below the head-side opening end 45*a*.

Also, the exhaust ports 24, i.e., the exhaust gas, can be cooled effectively by the exhaust-side water jacket 44 connecting with the exhaust-side connecting hole 46 below the head-side opening end 46*a*.

The present invention should not limited to the above-described embodiment, but any other modifications and improvements may be applied within the scope of a sprit of the present invention.

What is claimed is:

1. A cylinder head structure of an engine, in which there are provided two intake ports and two exhaust ports for each cylinder of a multi-cylinder engine and an engine cooling water is circulated in a cylinder head, comprising:

a main water jacket to form part of a head-side water jacket provided in the cylinder head, the main water jacket being separated by an upper face of a bottom deck of the cylinder head forming a combustion chamber of the cylinder and extending from an engine front end portion to an engine rear end;

an intake-side connecting hole and exhaust-side connecting hole to form part of the head-side water jacket, the intake-side and exhaust-side connecting holes being provided at a portion located between cylinders of the bottom deck of the cylinder head and at outer both sides in an engine width direction respectively so as to interconnect said main water jacket and a water jacket formed in a cylinder block; and a lateral rib provided at an upper face of the portion located between cylinders of bottom deck of the cylinder head so as to extend in the engine width direction, the lateral rib bifurcating at both ends thereof so as to get around said intake-side and exhaust-side connecting holes respectively, both ends of bifurcated portions of the lateral rib being respectively connected integrally with intake-port walls and exhaust-port walls of adjacent cylinders which respectively forms the intake ports and exhaust ports, a top portion of said lateral rib being configured so as to become taller gradually from a central portion thereof toward outside portions thereof in the engine width direction.

2. The cylinder head structure of an engine of claim 1, further comprising an exhaust-side water jacket to form part of the head-side water jacket, wherein said exhaust-side water jacket is provided between the exhaust-port wall and the bottom deck of the cylinder head, and the exhaust-side water jacket connects with said exhaust-side connecting holes below an opening end of the exhaust-side connecting hole which opens at the main water jacket.

3. The cylinder head structure of an engine of claim 1, wherein below the intake port is provided a nozzle hole for a fuel injector which is provided so as to face the combustion chamber, there is further provided an intake-side water jacket to form part of the head-side water jacket between a nozzle-hole wall forming said nozzle hole and the intake-port wall, and said intake-side water jacket connects with said intake-side connecting holes below an opening end of the intake-side connecting hole which opens at the main water jacket.

4. The cylinder head structure of an engine of claim 1, wherein there is further provided a longitudinal rib at a central portion of the upper face of the bottom deck, and said longitudinal rib extends in the cylinder-line direction so as to be connected with said the lateral rib, crossing each other.

5. A cylinder head structure of an engine, in which there are provided two intake ports and two exhaust ports for each cylinder of a multi-cylinder engine and an engine cooling water is circulated in a cylinder head, comprising:

a nozzle hole for a fuel injector which is provided so as to face a combustion chamber of the cylinder, the nozzle hole being provided below the intake port;

a main water jacket to form part of a head-side water jacket provided in the cylinder head, the main water jacket being separated by an upper face of a bottom deck of the cylinder head forming the combustion chamber of the cylinder and extending from an engine front end portion to an engine rear end;

an intake-side connecting hole and exhaust-side connecting hole to form part of the head-side water jacket, the intake-side and exhaust-side connecting holes being provided at a portion located between cylinders of the bottom deck of the cylinder head and at outer both sides in an engine width direction respectively so as to interconnect said main water jacket and a water jacket formed in a cylinder block;

an intake-side water jacket to form part of the head-side water jacket, the intake-side water jacket being provided between a nozzle-hole wall forming said nozzle hole and an intake-port wall, the intake-side water jacket connecting with said intake-side connecting holes below an opening end of the intake-side connecting hole which opens at the main water jacket;

an exhaust-side water jacket to form part of the head-side water jacket, the exhaust-side water jacket being provided between an exhaust-port wall and the bottom deck of the cylinder head, the exhaust-side water jacket connecting with said exhaust-side connecting holes below an opening end of the exhaust-side connecting hole which opens at the main water jacket; and a lateral rib provided at an upper face of the portion located between cylinders of bottom deck of the cylinder head so as to extend in the engine width direction, the lateral rib bifurcating at both ends thereof so as to get around said intake-side and exhaust-side connecting holes respectively, both ends of bifurcated portions of the lateral rib being respectively connected integrally with intake-port walls and exhaust-port walls of adjacent cylinders which respectively forms the intake ports and exhaust ports, a top portion of said lateral rib being configured so as to become taller gradually from a central portion thereof toward outside portions thereof in the engine width direction.

* * * * *